US008968489B2

(12) United States Patent
Azuma et al.

(10) Patent No.: US 8,968,489 B2
(45) **Date of Patent: *Mar. 3, 2015**

(54) FERROMAGNETIC AMORPHOUS ALLOY RIBBON WITH REDUCED SURFACE DEFECTS AND APPLICATION THEREOF

(75) Inventors: Daichi Azuma, Myrtle Beach, SC (US); Ryusuke Hasegawa, Morristown, NJ (US); Yuichi Ogawa, Myrtle Beach, SC (US); Eric A. Theisen, Myrtle Beach, SC (US); Yuji Matsumoto, Tottori (JP)

(73) Assignees: Metglas, Inc., Conway, SC (US); Hitachi Metals, Ltd., Tokyo (JP)

( * ) Notice: Subject to any disclaimer, the term of this patent is extended or adjusted under 35 U.S.C. 154(b) by 380 days.

This patent is subject to a terminal disclaimer.

(21) Appl. No.: 12/923,076

(22) Filed: Aug. 31, 2010

(65) Prior Publication Data

US 2012/0049992 A1 Mar. 1, 2012

(51) Int. Cl.

| | |
|---|---|
| ***H01F 27/25*** | (2006.01) |
| ***B22D 11/00*** | (2006.01) |
| ***H01F 1/153*** | (2006.01) |
| ***B22D 11/06*** | (2006.01) |
| ***H01F 41/02*** | (2006.01) |

(52) U.S. Cl.

CPC ..... *B22D 11/0611* (2013.01); *H01F 1/15308* (2013.01); *H01F 27/25* (2013.01); *H01F 41/0226* (2013.01)

USPC ..... 148/304; 336/213; 164/462

(58) Field of Classification Search

USPC ..... 148/304

See application file for complete search history.

(56) References Cited

U.S. PATENT DOCUMENTS

| | | | | |
|---|---|---|---|---|
| 4,264,882 | A | 4/1981 | Tsuya et al. | |
| 4,768,458 | A * | 9/1988 | Arakawa et al. | 164/463 |
| 5,332,455 | A | 7/1994 | Chang et al. | |

(Continued)

FOREIGN PATENT DOCUMENTS

| | | |
|---|---|---|
| JP | 61-24208 | 2/1986 |
| JP | 11-302823 | 11/1999 |

OTHER PUBLICATIONS

Lim et al., Magnetic Properties of Amorphous Alloy Strips Fabricated by Planar Flow Casting (PFC), Journal of Physics, 144, 2009.*

(Continued)

*Primary Examiner* — Roy King
*Assistant Examiner* — Xiaowei Su

(57) ABSTRACT

A ferromagnetic amorphous alloy ribbon, a method of fabricating a ribbon and a wound transformer core are provided. The ribbon includes an alloy of $Fe_aSi_bB_cC_d$ where 80.5≤a≤83 at. %, 0.5≤b≤6 at. %, 12≤c≤16.5 at. %, 0.01≤d≤1 at. % with a+b+c+d=100, and is cast from a molten state of the alloy, having a-surface tension of greater than or equal to 1.1 N/mi,. A defect length along a direction of the ribbon's length is between 5 mm and 200 mm, a defect depth less than 0.4 ×t μm and a defect occurrence frequency less than 0.05 ×w times within 1.5 m of ribbon length, where t is the ribbon thickness and w is the ribbon width in mm. The ribbon has a saturation magnetic induction exceeding 1.60 T and a magnetic core loss of less than 0.14 W/kg when measured at 60 Hz and at 1.3 T induction level in an annealed straight strip form, and a core magnetic loss of less than 0.3 W/kg and an exciting power of less than 0.4 VA/kg in an annealed wound transformer core form and is suitable for use in transformer cores, rotational machines, electrical chokes, magnetic sensors and pulse power devices.

22 Claims, 9 Drawing Sheets

(56) References Cited

U.S. PATENT DOCUMENTS

| | | | | |
|---|---|---|---|---|
| 5,741,373 | A | 4/1998 | Suzuki et al. | |
| 6,273,967 | B1 * | 8/2001 | Matsuki et al. | 148/304 |
| 6,425,960 | B1 * | 7/2002 | Yoshizawa et al. | 148/300 |
| 7,425,239 | B2 | 9/2008 | Ogawa et al. | |
| 7,988,798 | B2 * | 8/2011 | Ozaki et al. | 148/304 |
| 2006/0000524 | A1 * | 1/2006 | Ogawa et al. | 148/304 |
| 2006/0000525 | A1 * | 1/2006 | Naoe et al. | 148/304 |
| 2006/0191602 | A1 * | 8/2006 | Hasegawa et al. | 148/304 |
| 2009/0065100 | A1 * | 3/2009 | Yoshizawa et al. | 148/305 |
| 2009/0145524 | A1 * | 6/2009 | Ogawa et al. | 148/304 |
| 2010/0163136 | A1 * | 7/2010 | Ozaki et al. | 148/304 |

OTHER PUBLICATIONS

International Search Report and Written Opinion of the International Searching Authority mailed Jan. 12, 2012 issued in corresponding International Patent Application No. PCT/US11/49704.

International Preliminary Report on Patentability issued Aug. 24, 2012 in corresponding International Patent Application No. PCT/US11/49704.

Office Action mailed Sep. 3, 2013 in U.S. Appl. No. 12/923,074.

Office Action mailed Sep. 12, 2013 in U.S. Appl. No. 12/923,224.

Taiwanese Office Action for related Taiwanese Patent Application No. 100131134, issued on Jan. 23, 2014.

Taiwanese Office Action for related Taiwanese Patent Application No. 100131136, mailed on Jan. 23, 2014.

Japanese Office Action dated Aug. 1, 2014 in related Japanese Patent Application No. 2013-527186.

Japanese Office Action dated Aug. 1, 2014 in corresponding Japanese Patent Application No. 2013-527188.

U.S. Office Action dated Jul. 30, 2014 in related U.S. Appl. No. 12/923,224.

U.S. Office Action dated Aug. 6, 2014 in related U.S. Appl. No. 12/923,074.

* cited by examiner

Ribbon Length Direction →

FERROMAGNETIC AMORPHOUS ALLOY RIBBON WITH REDUCED SURFACE DEFECTS AND APPLICATION THEREOF

BACKGROUND

1. Field

The present invention relates to a ferromagnetic amorphous alloy ribbon for use in transformer cores, rotational machines, electrical chokes, magnetic sensors and pulse power devices and a method of fabrication of the ribbon.

2. Description of the Related Art

Iron-based amorphous alloy ribbon exhibits excellent soft magnetic properties including low magnetic loss under AC excitation, finding its application in energy efficient magnetic devices such as transformers, motors, generators, energy management devices including pulse power generators and magnetic sensors. In these devices, ferromagnetic materials with high saturation inductions and high thermal stability are preferred. Furthermore, the ease of the materials' manufacturability and their raw material costs are important factors in large scale industrial use. Amorphous Fe—B—Si based alloys meet these requirements. However, the saturation inductions of these amorphous alloys are lower than those of crystalline silicon steels conventionally used in devices such as transformers, resulting in somewhat larger sizes of the amorphous alloy-based devices. Thus efforts have been made to develop amorphous ferromagnetic alloys with higher saturation inductions. One approach is to increase the iron content in the Fe-based amorphous alloys. However, this is not straightforward as the alloys' thermal stability degrades as the Fe content increases. To mitigate this problem, elements such as Sn, S, C and P have been added. For example, U.S. Pat. No. 5,456,770 (the '770 patent) teaches amorphous Fe—Si—B—C—Sn alloys in which the addition of Sn increases alloys' formability and their saturation inductions. In U.S. Pat. No. 6,416,879 (the '879 patent), the addition of P in an amorphous Fe—Si—B—C—P system is taught to increase saturation inductions with increased Fe content. However, addition of such elements as Sn, S and C in the Fe—Si—B-based amorphous alloys reduces the ductility of the cast ribbon rendering it difficult to fabricate a wide ribbon. Also, the addition of P in the Fe—Si—B—C-based alloys as taught in the '879 patent results in loss of long-term thermal stability which in turn leads to increase of magnetic core loss by several tens of percentage within several years. Thus the amorphous alloys taught in the '770 and '879 patents have not been practically fabricated by casting from their molten states.

In addition to a high saturation induction needed in magnetic devices such as transformers, inductors and the like, a high B—H squareness ratio and low coercivity, $H_c$, are desirable with B and H being magnetic induction and exciting magnetic field, respectively. The reason for this is: such magnetic materials have high degree of magnetic softness, meaning ease of magnetization. This leads to low magnetic losses in the magnetic devices using these magnetic materials. Realizing these factors, some of the present inventors found that these required magnetic properties in addition to high ribbon-ductility were achieved by maintaining C precipitation layer on ribbon surface at a certain thickness by selecting the ratio of Si:C at certain levels in an amorphous Fe—Si—B—C system as described in U.S. Pat. No. 7,425,239. Furthermore, in Japanese Kokai Patent No. 2009052064, a high saturation induction amorphous alloy ribbon is provided, which shows improved thermal stability of up to 150 years at 150° C. device operation by controlling the C precipitation layer height with addition of Cr and Mn into the alloy system.

However, the fabricated ribbon exhibited a number of surface defects such as split lines, scratches and face lines formed along the ribbon's length direction and on the ribbon surface facing the casting atmosphere-side which is opposite to the ribbon surface contacting the casting chill body surface. Examples of a split line and face lines are shown in FIG. 1. The basic arrangement of casting nozzle, chill body surface on a rotating wheel and resulting cast ribbon is illustrated in U.S. Pat. No. 4,142,571.

Thus, there is a need for a ferromagnetic amorphous alloy ribbon which exhibits a high saturation induction, a low magnetic loss, a high B—H squareness ratio, high mechanical ductility, high long-term thermal stability, and reduced ribbon surface defects with high level of ribbon fabricability, which is one of the aspects of the present invention. More specifically, a thorough study of the cast ribbon surface quality during casting led to the following findings: the surface defects started early stage of casting, and when the defect length along ribbon's length direction exceeded about 200 mm or defect depth exceeding about 40% of the ribbon thickness, the ribbon broke at the defect site, resulting in abrupt termination of casting. Because of this ribbon breakage, the rate of cast termination within 30 minutes after cast start-up amounted to about 20%. On the other hand, for the ribbon having saturation inductions of less than 1.6 T, the rate of cast termination within 30 minutes was about 3%. In addition, on these ribbons, defect length was less than 200 mm and defect depth was less than 40% of the ribbon thickness with defect incidence being one or two at every 1.5 m along ribbon's length direction. Thus reduction of surface defects on the ribbon with saturation inductions exceeding 1.6 T is clearly needed to achieve continuous casting, which is yet another aim of the present invention. A primary aspect of the present invention is to provide a magnetic core suited for use in energy efficient devices such as transformers, rotational machines, electrical chokes, magnetic sensors and pulse power devices.

SUMMARY

In accordance with aspects of the invention, a ferromagnetic amorphous alloy ribbon is based on an alloy having a composition represented by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with $a+b+c+d=100$ and incidental impurities. The ribbon is cast from a molten state of the alloy, with a molten alloy surface tension of greater than and equal to 1.1 N/m, and the ribbon having a ribbon length, a ribbon thickness, a ribbon width, and a ribbon surface facing a casting atmosphere side. The ribbon has ribbon surface defects formed on the ribbon surface facing the casting atmosphere side, and the ribbon surface defects are measured in terms of a defect length, a defect depth, and defect occurrence frequency. The defect length along a direction of the ribbon's length being between 5 mm and 200 mm, the defect depth being less than 0.4×t μm and the defect occurrence frequency being less than 0.05×w times within 1.5 m of ribbon length, where t is the ribbon thickness and w is the ribbon width. The ribbon has a saturation magnetic induction exceeding 1.60 T and exhibiting a magnetic core loss of less than 0.14 W/kg when measured at 60 Hz and at 1.3 T induction level in an annealed straight strip form. The ribbon has a core magnetic loss of less than 0.3 W/kg and an exciting power of less than 0.4 VA/kg at 60 Hz and 1.3 T induction when the ribbon is wound in core form and annealed with magnetic fields applied along the ribbon's length direction.

According to one aspect of the invention, the Si content b and the B content c are related to the Fe content a and the C content d according to relations of $b \geq 166.5 \times (100-d)/100-2a$ and $c \leq a-66.5 \times (100-d)/100$. This results in molten metal surface tension exceeding 1.3 N/m which is more preferred.

According to another aspect of the invention, the ribbon further includes a trace element Cu, the content of Cu being between 0.005 wt. % and 0.20 wt. %. Trace element is helpful in reducing ribbon surface defects.

According to an additional aspect of the invention, the ribbon further includes trace elements Mn and Cr, the content of Mn being between 0.05 wt. % and 0.30 wt. %, and the content of Cr being between 0.01 wt. % and 0.2 wt. %. Trace elements are helpful in reducing ribbon surface defects.

According to yet another aspect of the invention, in the ribbon, up to 20 at. % of Fe is optionally replaced by Co, and up to 10 at. % Fe is optionally replaced by Ni.

According to yet an additional aspect of the invention, the ribbon is cast from a molten state of the alloy at temperatures between 1,250° C. and 1,400° C.

According to another aspect of the invention, the ribbon is cast in an environmental atmosphere containing less than 5 vol. % oxygen at the molten alloy-ribbon interface.

According to an additional aspect of the invention, a wound transformer core includes a ferromagnetic amorphous alloy ribbon having a chemical composition represented by $Fe_a Si_b B_c C_d$ where $81 \leq a < 82.5$ at. %, $2.5 < b < 4.5$ at. %, $12 \leq c \leq 16$ at. %, $0.01 \leq d \leq 1$ at. % with $a+b+c+d=100$ and satisfying the relations of $b \geq 166.5 \times (100-d)/100-2a$ and $c \leq a-66.5 \times (100-d)/100$. The alloy may have a trace element selected from at least one of Cu, Mn, and Cr, such that the Cu content is at 0.005-0.20 wt. %, the Mn content is at 0.05-0.30 wt. % and the Cr content is at 0.01-0.2 wt. %. The alloy may have less than 20 at. % Fe is optionally replaced by Co, and less than 10 at. % Fe is optionally replaced by Ni. The ribbon has reduced surface defects by controlling molten metal surface tension during casting. A wound transformer core based on the ribbon is annealed at a temperature range between 300° C. and 335° C. in magnetic fields applied along the direction of the ribbon's length, and the core exhibits magnetic core loss of less than 0.25 W/kg and exciting power of less than 0.35 VA/kg when measured at 60 Hz and 1.3 induction. In another aspect, the transformer core is operated up to an induction level of 1.5-1.55 T at room temperature. In yet another aspect, the transformer core has a toroidal shape or semi-toroidal shape. In yet an additional aspect, the transformer core has step-lap joints. In one more aspect, the transformer core has over-lap joints.

According to an additional aspect of the invention, a method of fabricating a ferromagnetic amorphous alloy ribbon includes selecting an alloy having a composition represented by $Fe_a Si_b B_c C_d$ where $80.5 \leq a \leq 83$ at. %, $0.5 \leq b \leq 6$ at. %, $12 \leq c \leq 16.5$ at. %, $0.01 \leq d \leq 1$ at. % with $a+b+c+d=100$ and incidental impurities; casting the ribbon from a molten state of the alloy, with a molten alloy surface tension greater than and equal to 1.1 N/m; and obtaining the ribbon having a ribbon length, a ribbon thickness, and a ribbon width. The cast ribbon has surface defects formed on the surface facing the casting atmosphere side. The defect length along a direction of the ribbon's length being between 5 mm and 200 mm, the defect depth being less than 0.4×t μm and the defect occurrence frequency being less than 0.05×w times within 1.5 m of ribbon length, where t is the ribbon thickness and w is the ribbon width. The ribbon has a saturation magnetic induction exceeding 1.60 T and exhibiting a magnetic core loss of less than 0.14 W/kg when measured at 60 Hz and at 1.3 T induction level in an annealed straight strip form, and the ribbon has a core magnetic loss of less than 0.3 W/kg and an exciting power of less than 0.4 VA/kg in an annealed wound transformer core form.

In one aspect of the above ribbon fabrication method, casting is performed at the melt temperature between 1,250° C. and 1,400° C. and the molten metal surface tension is in the range of 1.1 N/m-1.6 N/m. Under this casting condition, the ribbon surface defects such as shown in FIG. 1 on the ribbon surface facing the casting atmosphere-side are such that the defect length along ribbon's length direction is between 5 mm and 200 mm, the defect depth is 0.4×t μm and the defect occurrence frequency is less than 0.05×w times within 1.5 m of ribbon length, where t and w are ribbon thickness and ribbon width, respectively.

BRIEF DESCRIPTION OF THE DRAWINGS

The invention will be more fully understood and further advantages will become apparent when reference is made to the following detailed description of the preferred embodiments and the accompanying drawings in which.

DETAILED DESCRIPTION

Figure 1:
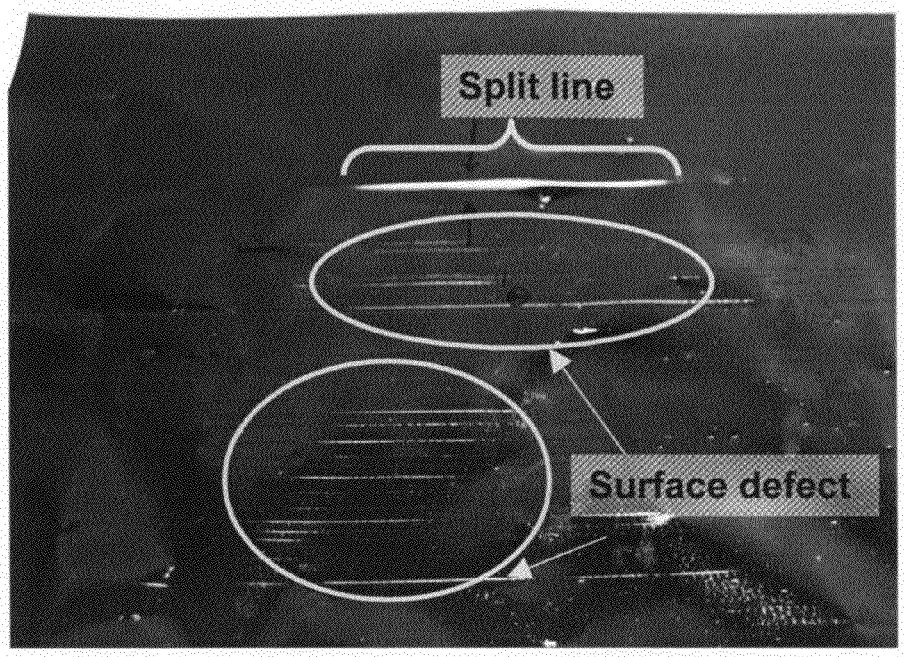
FIG. 1 is a picture showing defects such as split line and face lines formed on the ribbon surface during casting.

An amorphous ally ribbon may be prepared as taught in U.S. Pat. No. 4,142,571, by having a molten alloy ejected through a slotted nozzle onto a rotating chill body surface. The ribbon surface facing the chill body surface looks dull but the opposite side surface facing atmosphere is shiny reflecting liquid nature of the molten alloy. In the following description, this side is also called "shiny side" of a cast ribbon. It was found that small amounts of molten alloy splash stick on the nozzle surface and were quickly solidified when the molten alloy surface tension was low, resulting in surface defects such as split lines, face lines and scratch-like lines formed along the ribbon length direction and on the ribbon's shiny side. The split lines penetrate across the ribbon thickness. Examples of a split line and face lines are shown in FIG. 1. This in turn degraded the soft magnetic properties of the ribbon. More damaging was that the cast ribbon tended to split or break at the defect sites, resulting in termination of ribbon casting.

Further observation revealed the following: during casting, the number of the surface defects and their lengths and depths increased with casting time. This progression was found slower when defect lengths were between 5 mm and 200 mm, defect depths were less than 0.4×t μm and the number of defects was less than 0.05×w along ribbon's length direction, where t and w were the thickness and width of a cast ribbon. Thus ribbon breakage incidence was also low. On the other hand, when the number of defects along the ribbon length direction was more than 0.05×w, the defect size increased, resulting in ribbon breakage. This indicated that, for a continuous casting without ribbon breakage, it was necessary to minimize the incidence of molten alloy splash on the nozzle surface. After a number of experimental trials, the present inventors found that maintaining the molten alloy surface tension at a high level was crucial to reduce the molten alloy splash.

For example, the effect of molten alloy surface tension was compared between a molten alloy at a melting temperature of 1,350° C. with a chemical composition of $Fe_{81.4}Si_2B_{16}C_{0.6}$ having a surface tension of 1.0 N/m and a molten alloy at a melting temperature of 1,350° C. with a chemical composition of $Fe_{81.7}Si_4B_{14}C_{0.3}$ having a surface tension of 1.3 N/m. The molten alloy with $Fe_{81.4}Si_2B_{16}C_{0.6}$ showed more splash on the nozzle surface than $Fe_{81.7}Si_4B_{14}C_{0.3}$ alloy, resulting in shorter casting time. When the ribbon surface was examined, the ribbon based on $Fe_{81.4}Si_2B_{16}C_{0.6}$ alloy had more than several defects within 1.5 m of the ribbon. On the other hand, no such defects were observed on the ribbon based on the $Fe_{81.7}Si_4B_{14}C_{0.3}$ alloy. A number of other alloys were examined in light of the molten alloy surface tension effects, resulting in the finding that molten alloy splash was frequent and the number of defects within 1.5 m of ribbon length was more than 0.05×w when the molten alloy surface tension was below 1.1 N/m. It is noted that efforts to minimize solidified molten alloy splash on the nozzle surface by treating the nozzle surface by surface coating and polishing failed. The inventors then came up with a method of varying molten alloy surface tension at the interface between the molten alloy and the ribbon by controlling the oxygen concentration near the interface.

The next step the present inventors took was to find the chemical composition range in which the saturation induction of a cast amorphous ribbon exceeded 1.60 T which was one of the objectives of the present invention. It was found that the alloy compositions meeting this requirement were expressed by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities commonly found in the commercial raw materials such as iron (Fe), ferrosilicon (Fe—Si) and ferroboron (Fe—B).

For Si and B contents, it was found that the following chemistry restriction was more favorable to achieve the objectives: b≥166.5×(100−d)/100−2a and c≤a−66.5×(100−d)/100.

In addition, for incidental impurities and intentionally added trace elements, the following elements with the given content ranges were found favorable: Mn at 0.05-0.30 wt. %, Cr at 0.01-0.2 wt. %, and Cu at 0.005-0.20 wt. %.

In addition, less than 20 at. % Fe is optionally replaced by Co and less than 10 at. % Fe was optionally replaced by Ni.

Figure 2:
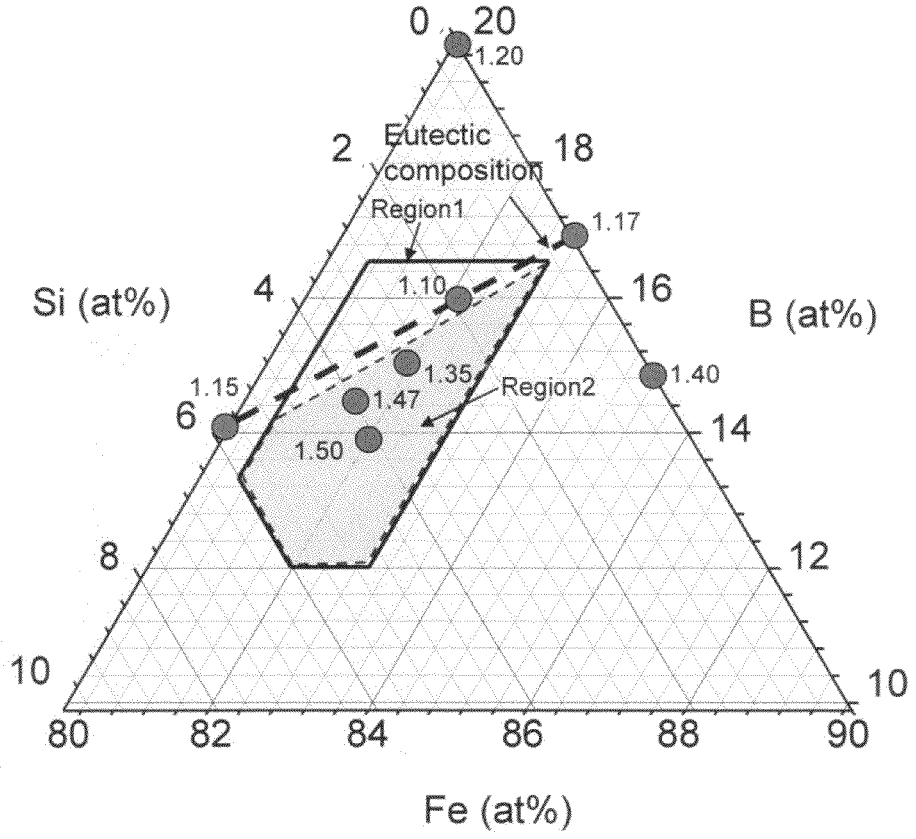
FIG. 2 is a diagram giving molten alloy surface tension on a Fe—Si—B phase diagram. The numbers shown indicate molten alloy surface tension in N/m.

The reasons for selecting the compositional ranges given in the three paragraphs noted above were the following: Fe content "a" of less than 80.5 at. % resulted in the saturation induction level of less than 1.60 T while "a" exceeding 83 at. % reduced alloy's thermal stability and ribbon formability. Replacing Fe by up to 20 at. % Co and/or up to 10 at. % Ni was favorable to achieve saturation induction exceeding 1.60 T. Si improved ribbon formability and enhanced its thermal stability for Si≥0.5 at. % and was less than 6 at. % to achieve envisaged saturation induction levels and high B—H squareness ratios. B contributed favorably to alloy's ribbon formability and its saturation induction level and exceeded 12 at. % and was less than 16.5 at. % as its favorable effects diminished above this concentration. These findings are summarized in the phase diagram of FIG. 2, in which Region 1 where molten alloy surface tension is at or more than 1.1 N/m and Region 2 where molten alloy surface tension exceeds 1.3 N/m are clearly indicated. In terms of chemical composition, Region 1 in FIG. 2 is defined by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and Region 2 is defined by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and b≥166.5×(100−d)/100−2a and c≤a−66.5×(100−d)/100. In FIG. 2, eutectic compositions are represented by a heavy dashed line, showing that the molten alloy surface tension is low near the alloy system's eutectic compositions.

C was effective to achieve a high B—H squareness ratio and a high saturation induction above 0.01 at. % but molten alloy's surface tension is reduced above 1 at. % C and less than 0.5 at. % C is preferred. Among the added trace elements, Mn reduced molten alloy's surface tension and allowable concentration limits was Mn<0.3 wt. %. More preferably, Mn<0.2 wt. %. Coexistence of Mn and C in Fe-based amorphous alloys improved alloys' thermal stability and (Mn+C) >0.05 wt. % was effective. Cr also improved thermal stability and was effective for Cr>0.01 wt. % but alloy's saturation induction decreased for Cr>0.2 wt. %. Cu is not soluble in Fe and tends to precipitate on ribbon surface and was helpful in increasing molten alloy's surface tension; Cu>0.005 wt. % was effective and Cu>0.02 wt. % was more favorable but C>0.2 wt. % resulted in brittle ribbon. It was found that 0.01-5.0 wt. % of one or more than one element from a group of Mo, Zr, Hf and Nb were allowable.

The alloy, in accordance with embodiments of the present invention had a melting temperature preferably between 1,250° C. and 1,400° C. and in this temperature range, the molten alloy's surface tension was in the range of 1.1 N/m-1.6 N/m. Below 1,250° C., nozzles tended to plug frequently and above 1,400° C. molten alloy's surface tension decreased. More preferred melting points were 1,280° C.-1,360° C.

Figure 3:
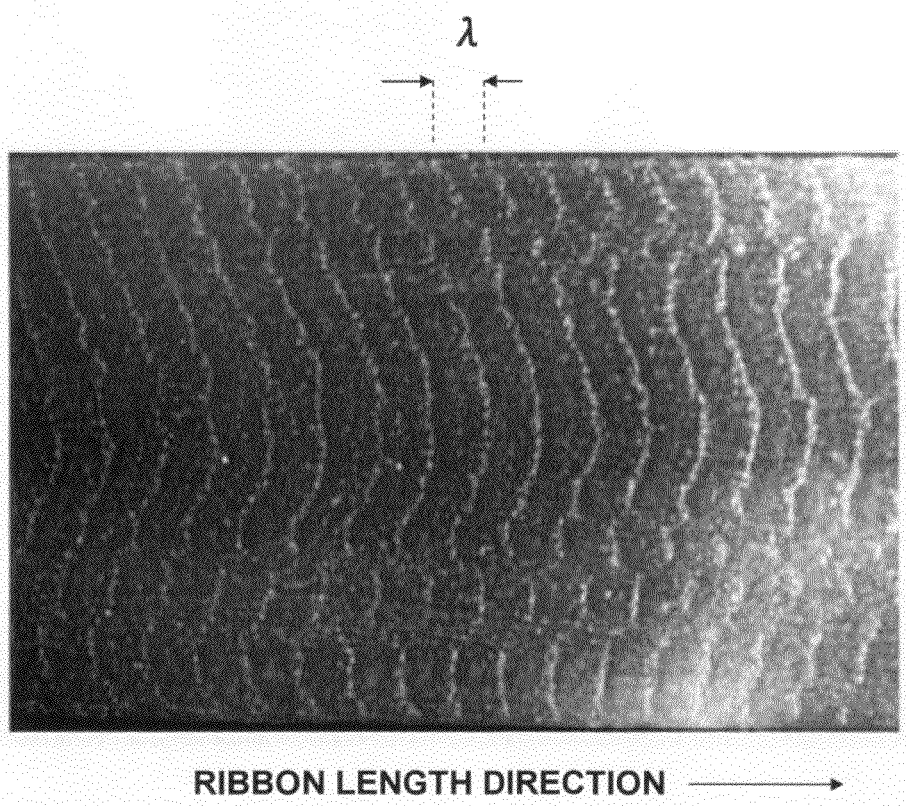
FIG. 3 is a picture illustrating a wavy pattern observed on a cast ribbon surface. The quantity λ is the wave length of the wavy pattern.

The molten alloy surface tension σ was determined by the following formula which was found in *Metallurgical and Materials Transactions*, vol. 37B, pp. 445-456 (published by Springer in 2006):

$$\sigma = U^2 G^3 \rho / 3.6\lambda^2$$

where U, G, ρ and λ are chill body surface velocity, gap between nozzle and chill body surface, mass density of alloy and wave length of wavy pattern observed on the shiny side of ribbon surface as indicated in FIG. 3, respectively. The measured wavelength, λ, was in the range of 0.5 mm-2.5 mm.

Figure 4:
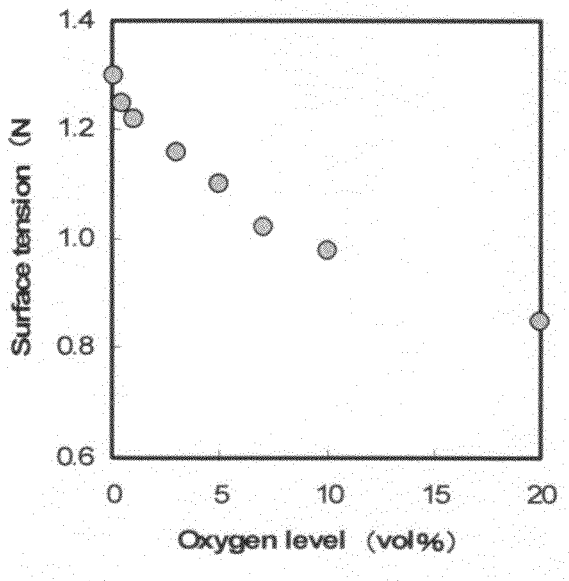
FIG. 4 is a graph showing molten alloy surface tension as a function of oxygen concentration in the vicinity of molten alloy-ribbon interface.

The inventors found that the surface defects could be further reduced by providing oxygen gas with a concentration of up to 5 vol. % at the interface between molten alloy and cast ribbon right below the casting nozzle. The upper limit for $O_2$ gas was determined based on the data of molten alloy surface tension versus $O_2$ concentration shown in FIG. 4 which indicated that molten alloy surface tension became less than 1.1 N/m for the oxygen gas concentration exceeding 5 vol. %.

The inventors further found that the ribbon thickness from 10 μm to 50 μm was obtained in accordance with embodiments of the invention for the ribbon fabrication method. It was difficult to form a ribbon for thickness below 10 μm and above ribbon thickness of 50 μm ribbon's magnetic properties deteriorated.

The fabrication methods, according to embodiments of the invention, were applicable to wider amorphous alloy ribbons as indicated in Example 4.

To the surprise of the inventors, a ferromagnetic amorphous alloy ribbon showed a low magnetic core loss, contrary to the expectation that core loss generally increased when core material's saturation induction increased. For example, straight strips of ferromagnetic amorphous alloy ribbons, according to embodiments of the present invention, which were annealed at a temperature between 320° C. and 330° C. with a magnetic field of 1,500 A/m applied along strips' length direction exhibited magnetic core loss of less than 0.14 W/kg when measured at 60 Hz and at 1.3 T induction.

A low magnetic core loss in a straight strip translates to correspondingly low magnetic core loss in a magnetic core prepared by winding a magnetic ribbon. However, due to the mechanical stress introduced during core winding, a wound core always exhibits magnetic core loss higher than that in its straight strip form. The ratio of wound core's core loss to straight strip's core loss is termed building factor (BF). The BF values are about 2 for optimally designed commercially available transformer cores based on amorphous alloy ribbons. A low BF is obviously preferred. In accordance with further embodiments of the present invention, transformer cores with over-lap joints were built using amorphous alloy ribbons fabricated according to embodiments of the present invention. The dimension of the cores built and tested is given in FIG. 5.

Figure 6:
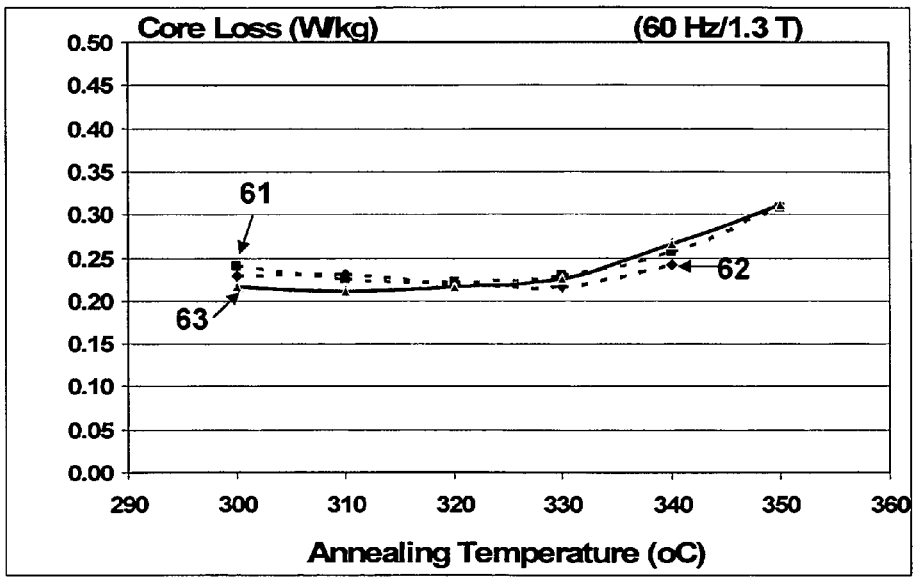
FIG. 6 is a graph showing core loss at 60 Hz excitation and at 1.3 T induction as a function of annealing temperature for amorphous $Si_2B_{16}$, $Si_3B_{15}$ and $Si_4B_{14}$ alloy ribbons in accordance with the present invention.
Figure 7:
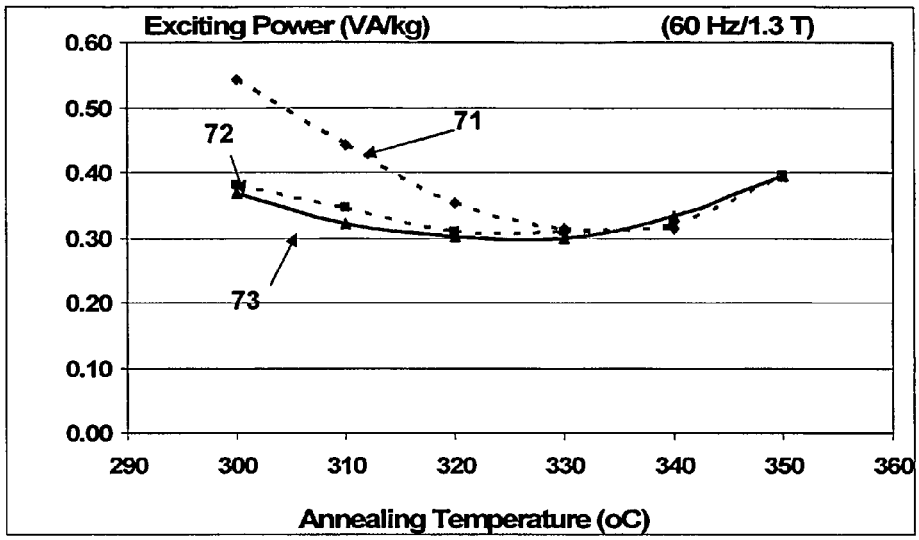
FIG. 7 is a graph showing exciting power at 60 Hz excitation and at 1.3 T induction as a function of annealing temperature for amorphous $Si_2B_{16}$, $Si_3B_{15}$ and $Si_4B_{14}$ alloy ribbon of the present invention.
Figure 8:
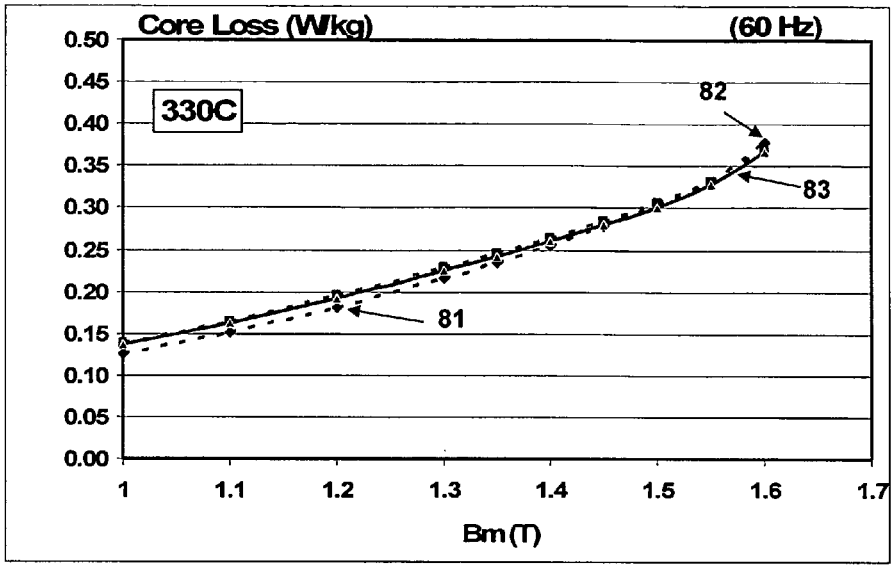
FIG. 8 is a graph showing core loss at 60 Hz excitation as a function of magnetic induction, $B_m$, for amorphous $Si_2B_{16}$, $Si_3B_{15}$ and $Si_4B_{14}$ alloy ribbon of the present invention.
Figure 9:
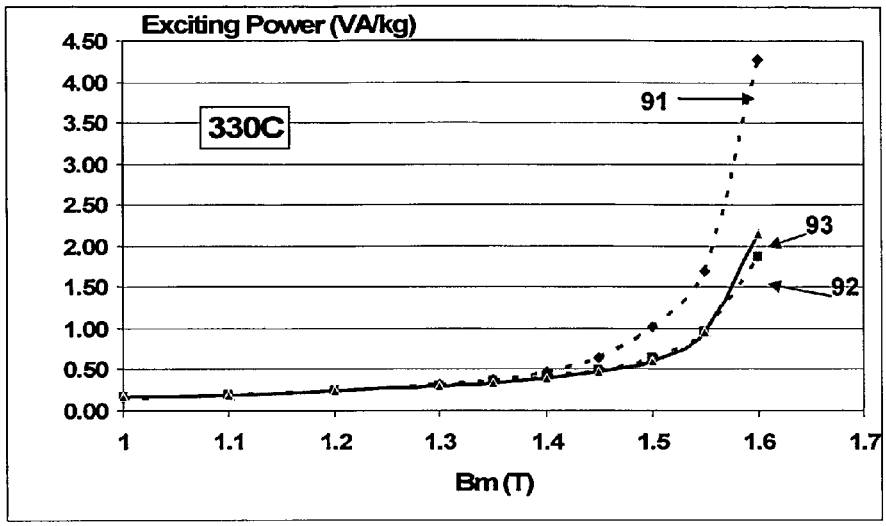
FIG. 9 is a graph showing exciting power at 60 Hz excitation as a function of magnetic induction, $B_m$, for amorphous $Si_2B_{16}$, $Si_3B_{15}$ and $Si_4B_{14}$ alloys of the present invention.

Although core loss levels were about the same among the transformer cores based on amorphous $Fe_{81.7}Si_2B_{16}C_{0.3}$ (hereinafter $Si_2B_{16}$ alloy), $Fe_{81.7}Si_3B_{15}C_{0.3}$ (hereinafter $Si_3B_{15}$ alloy) and $Fe_{81.7}Si_4B_{14}C_{0.3}$ ($Si_4B_{14}$ alloy) alloy ribbons as indicated in Tables 6 and 7 and FIGS. 6 and 8, transformer cores with alloys having higher Si content showed the following two advantageous features. First, as indicated in FIG. 7, the annealing temperature range in which exciting power was low was much wider in the amorphous alloys containing 3-4 at. % Si than in an amorphous alloy containing 2 at. % Si. Second, as indicated in FIGS. 8 and 9, the transformer cores with amorphous alloy ribbons containing 3-4 at. % Si annealed in the temperature range between 300° C. and 335° C. in a magnetic field applied along ribbon's length direction were operated up to 1.5-1.55 T induction range at room temperature whereas the amorphous alloy with 2 at. % Si was operable up to about 1.45 T. This difference is significant in reducing transformer size. It is estimated that transformer size can be reduced by 5-10% for incremental increase of its operating induction by 0.1 T. Furthermore, transformer quality improves when exciting power is low. In light of the technical advantages just described, transformer cores having the compositions in accordance with embodiments of the present invention were tested and the results indicated that optimal transformer performance was achieved in the alloys with the chemical compositions represented by $Fe_aSi_bB_cC_d$ where $81 \le a < 82.5$ at. %, $2.5 < b < 4.5$ at. %, $12 \le c \le 16$ at. %, $0.01 \le d \le 1$ at. % with $a+b+c+d=100$ and satisfying the relations of $b \ge 166.5 \times (100-d)/100-2a$ and $c \le a-66.5 \times (100-d)/100$.

EXAMPLE 1

Ingots with chemical compositions, in accordance with embodiments of the present invention, were prepared and were cast from molten metals at 1,350° C. on a rotating chill body. The cast ribbons had a width of 100 mm and its thickness was in 22-24 μm range. A chemical analysis showed that the ribbons contained 0.10 wt. % Mn, 0.03 wt. % Cu and 0.05 wt. % Cr. A mixture of $CO_2$ gas and oxygen was blown into near the interface between molten alloy and the cast ribbon. The oxygen concentration near the interface between molten alloy and the cast ribbon was 3 vol %. The molten alloy surface tension, σ, was determined by measuring the wave length of the wavy pattern on the shiny side of the cast ribbon using the formula $\sigma = U^2G^3\rho/3.6\lambda^2$. Ribbon surface defect number within 1.5 m along ribbon's length direction was measured 30 minutes after cast start-up and the maximum number of surface defects, N, is given in Table 1. Single strips cut from the ribbons were annealed at 300° C.-400° C. with a magnetic field of 1500 A/m applied along strips' length direction and the magnetic properties of the heat-treated strips were measured according to ASTM Standards A-932. The results obtained are listed in Table 1. The samples Nos. 1-15 met requirements of the invention objections for molten alloy surface tension, σ, number of defects per 1.5 m of the cast ribbon, N, saturation induction, $B_s$, and magnetic core loss $W_{1.3/60}$ at 60 Hz excitation at 1.3 T induction. Since the ribbon width was 100 mm, the maximum number for N was 5. Table 2 gives examples of failed ribbons, samples Nos. 1-6. For example, samples Nos. 1, 3 and 4 showed favorable magnetic properties but a number of ribbon surface defects resulted due to the molten alloy surface tension being lower than 1.1 N/m. The molten alloy surface tensions for samples Nos. 2 5 and 6 were higher than 1.1 N/m resulting in N=0 but $B_s$ was lower than 1.60 T.

TABLE 1

| Sample | Composition (at %) | | | | | | σ | | $B_s$ | $W_{1.3/60}$ |
|---|---|---|---|---|---|---|---|---|---|---|
| No. | Fe | Co | Ni | Si | B | C | (N/m) | N | (T) | (W/kg) |
| 1 | 81.7 | 0 | 0 | 3 | 15 | 0.3 | 1.16 | 2 | 1.63 | 0.094 |
| 2 | 81.7 | 0 | 0 | 4 | 14 | 0.3 | 1.31 | 0 | 1.63 | 0.093 |
| 3 | 81.0 | 0 | 0 | 6 | 12 | 1 | 1.48 | 0 | 1.61 | 0.101 |
| 4 | 80.5 | 0 | 0 | 5 | 14.2 | 0.3 | 1.13 | 2 | 1.62 | 0.103 |
| 5 | 81.7 | 0 | 0 | 4.5 | 13.5 | 0.3 | 1.38 | 0 | 1.62 | 0.094 |
| 6 | 83.0 | 0 | 0 | 0.5 | 16.5 | 0.01 | 1.22 | 0 | 1.62 | 0.135 |
| 7 | 81.7 | 0 | 0 | 5 | 13 | 0.3 | 1.43 | 0 | 1.62 | 0.095 |
| 8 | 81.7 | 0 | 0 | 2.3 | 16 | 0.01 | 1.11 | 4 | 1.64 | 0.095 |
| 9 | 80.5 | 0 | 0 | 6 | 13.2 | 0.3 | 1.55 | 0 | 1.60 | 0.099 |
| 10 | 80.5 | 0 | 0 | 2.7 | 16.5 | 0.3 | 1.18 | 2 | 1.62 | 0.105 |
| 11 | 83.0 | 0 | 0 | 4.7 | 12 | 0.3 | 1.58 | 0 | 1.62 | 0.109 |
| 12 | 76.7 | 5 | 0 | 4 | 14 | 0.3 | 1.34 | 0 | 1.70 | 0.104 |
| 13 | 61.7 | 20 | 0 | 4 | 14 | 0.3 | 1.36 | 0 | 1.78 | 0.101 |
| 14 | 79.7 | 0 | 2 | 4 | 14 | 0.3 | 1.27 | 0 | 1.65 | 0.100 |
| 15 | 71.7 | 0 | 10 | 4 | 14 | 0.3 | 1.25 | 0 | 1.60 | 0.103 |

TABLE 2

| Ref. | Composition (at %) | | | | σ | | $B_s$ | $W_{1.3/60}$ |
|---|---|---|---|---|---|---|---|---|
| sample No. | Fe | Si | B | C | (N/m) | N | (T) | (W/kg) |
| 1 | 81.4 | 2 | 16 | 0.6 | 0.95 | 6 | 1.64 | 0.091 |
| 2 | 79.7 | 8 | 12 | 0.3 | 1.45 | 0 | 1.57 | 0.095 |
| 3 | 81 | 3 | 14.8 | 1.2 | 1.05 | 12 | 1.63 | 0.103 |
| 4 | 80.5 | 4 | 14.9 | 0.6 | 0.90 | 12 | 1.62 | 0.096 |
| 5 | 83.7 | 2 | 14 | 0.3 | 1.58 | 0 | 1.58 | 0.124 |
| 6 | 81.7 | 8 | 10 | 0.3 | 1.68 | 0 | 1.59 | 0.120 |

EXAMPLE 2

An amorphous alloy ribbon having a composition of $Fe_{81.7}Si_3B_{15}C_{0.3}$ was cast under the same casting condition as in Example 1 except that $O_2$ gas concentration was changed from 0.1 vol. % to 20 vol. % (equivalent to air). The magnetic properties, $B_s$ and $W_{1.3/60}$ and molten alloy surface tension σ and maximum number of surface defects, N obtained are listed in Table 3. The data demonstrate that oxygen level exceeding 5 vol. % reduces molten alloy surface tension, which in turn increase the defect number leading to shorter cast time.

TABLE 3

| Sample No. | Oxygen level Vol. (%) | σ (N/m) | N | $B_s$ (T) | $W_{1.3/60}$ (W/kg) |
|---|---|---|---|---|---|
| 16 | 5 | 1.10 | 4 | 1.60 | 0.095 |
| 1 | 3 | 1.16 | 2 | 1.63 | 0.094 |
| 17 | 1 | 1.22 | 0 | 1.63 | 0.094 |
| 18 | 0.5 | 1.25 | 0 | 1.63 | 0.093 |
| Ref. sample No. | Oxygen level Vol. (%) | σ (N/m) | N | $B_s$ (T) | W13/60 (W/kg) |
| 7 | 20 (Air) | 0.85 | 8 | 1.63 | 0.140 |
| 8 | 10 | 0.98 | 6 | 1.63 | 0.100 |
| 9 | 7 | 1.02 | 6 | 1.63 | 0.096 |

EXAMPLE 3

Small amount of Cu was added to the alloy of Example 2 and the ingots were cast into amorphous alloy ribbons as in Example 1. The magnetic properties, $B_s$ and $W_{1.3/60}$ and molten alloy surface tension and the maximum defect number, N on the ribbons are compared in Table 4. The ribbon with 0.25 wt. % Cu showed favorable magnetic properties but was brittle. No increase in the molten alloy surface tension was observed in the ribbon with 0.001 wt. % Cu.

TABLE 4

| | Cu wt. % | σ (N/m) | N | $B_s$ (T) | $W_{1.3/60}$ (W/kg) |
|---|---|---|---|---|---|
| Sample No. | | | | | |
| 1 | 0.03 | 1.16 | 2 | 1.63 | 0.094 |
| 19 | 0.20 | 1.25 | 0 | 1.63 | 0.093 |
| 20 | 0.005 | 1.11 | 4 | 1.63 | 0.106 |
| Ref. sample No. | | | | | |
| 10 | 0.001 | 1.05 | 6 | 1.62 | 0.091 |
| 11 | 0.25 | 1.28 | 0 | 1.61 | 0.108 |

EXAMPLE 4

An amorphous alloy ribbon having a composition of $Fe_{81.7}Si_3B_{15}C_{0.3}$ was cast under the same condition as in Example 1 except that ribbon width was changed from 140 mm to 254 mm and the ribbon thickness was changed from 15 μm to 40 μm. The magnetic properties, $B_s$, $W_{1.3/360}$ and molten alloy surface tension σ and maximum number of surface defects, N, obtained are listed in Table 5.

TABLE 5

| Sample No. | Thickness (μm) | Width (mm) | σ (N/m) | N | $B_s$ (T) | $W_{1.3/60}$ (W/kg) |
|---|---|---|---|---|---|---|
| 21 | 25 | 140 | 1.16 | 3 | 1.63 | 0.098 |
| 22 | 25 | 170 | 1.16 | 3 | 1.63 | 0.100 |
| 23 | 25 | 210 | 1.16 | 4 | 1.63 | 0.101 |
| 24 | 25 | 254 | 1.16 | 5 | 1.63 | 0.105 |
| 25 | 15 | 170 | 1.16 | 3 | 1.63 | 0.105 |
| 26 | 22 | 170 | 1.16 | 4 | 1.63 | 0.101 |
| 27 | 30 | 170 | 1.16 | 3 | 1.63 | 0.106 |
| 28 | 40 | 170 | 1.16 | 2 | 1.63 | 0.114 |

EXAMPLE 5

Figure 5:
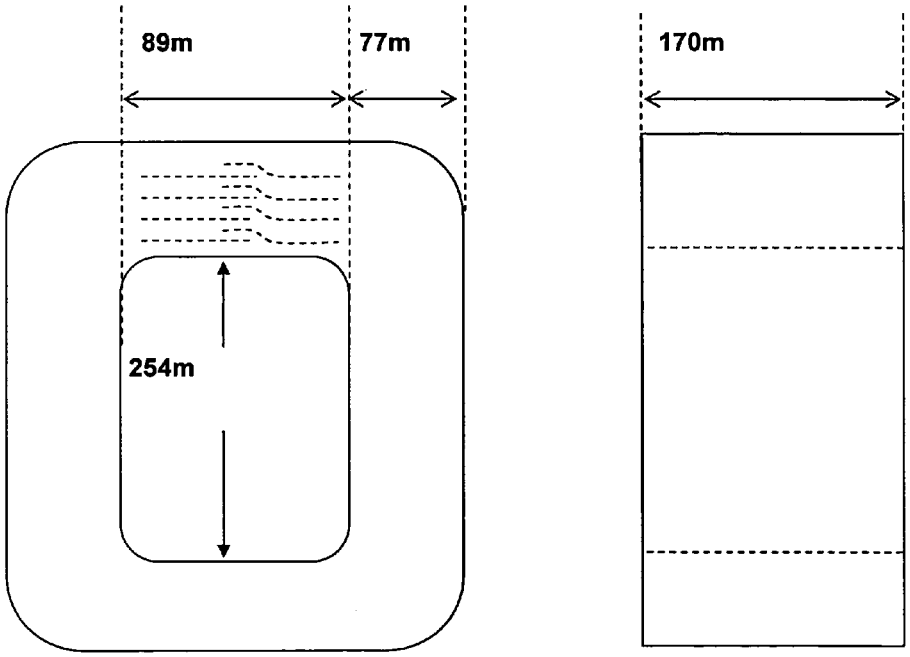
FIG. 5 is a diagram illustrating a transformer core with over-lap joints.

Utilizing $Fe_{81.7}Si_2B_{16}C_{0.3}$ ($Si_2B_{16}$ alloy), $Fe_{81.7}Si_3B_{15}C_{0.3}$ ($Si_3B_{15}$ alloy) and $Fe_{81.7}Si_4B_{14}C_{0.3}$ ($Si_4B_{14}$ alloy) ribbon of the present invention, transformer cores with over-lap joints were built. The core dimension is shown in FIG. 5. The transformer cores were annealed in the temperature range of 300° C.-350° C. for one hour with a magnetic field of 2,000 A/m applied along ribbon's length direction. Core loss and exciting power which is the electrical power to energize a transformer depend on the annealing temperature of a transformer core, which is shown in FIGS. 6 and 7, respectively for the amorphous $Si_2B_{16}$ ribbon indicated by curves 61 (in FIG. 6) and 71 (in FIG. 7), $Si_3B_{15}$ alloy ribbon indicated by curves 62 (in FIG. 6) and 72 in (FIG. 7) and $Si_4B_{14}$ alloy ribbon indicated by curves 63 (in FIG. 6) and 73 (in FIG. 7) of the present invention. The cores were excited at 60 Hz and at 1.3 T induction. The digital data for $Si_2B_{16}$, $Si_3B_{15}$ and $Si_4B_{14}$ alloy ribbons are also listed in Table 6 below:

TABLE 6

| | $Si_2B_{16}$ Alloy | | $Si_3B_{15}$ Alloy | | $Si_4B_{14}$ Alloy | |
|---|---|---|---|---|---|---|
| Annealing Temperature (° C.) | Core Loss (W/kg) | Exciting Power (VA/kg) | Core Loss (W/kg) | Exciting Power (VA/kg) | Core Loss (W/kg) | Exciting Power (VA/kg) |
| 300 | — | — | 0.240 | 0.380 | 0.216 | 0.368 |
| 310 | 0.232 | 0.443 | 0.226 | 0.345 | 0.211 | 0.322 |
| 320 | 0.220 | 0.354 | 0.222 | 0.309 | 0.217 | 0.301 |
| 330 | 0.216 | 0.314 | 0.229 | 0.308 | 0.225 | 0.299 |
| 340 | 0.243 | 0.314 | 0.256 | 0.322 | 0.266 | 0.334 |
| 350 | — | — | 0.308 | 0.396 | 0.311 | 0.396 |

FIGS. 8 and 9 show core loss and exciting power in transformer cores based on $Si_2B_{16}$ alloy ribbon indicated by curves 81 (in FIG. 8) and 91 (in FIG. 9, $Si_3B_{15}$ alloy ribbon indicated by curves 82 (in FIG. 8) and 92 (in FIG. 9) and $Si_4B_{14}$ alloy ribbon indicated by curves 83 (in FIG. 8) and 93 (in FIG. 9) as a function of induction level, $B_m$, under 60 Hz excitation. The cores were annealed at 330° C. for one hour with a magnetic field of 2000 A/m applied along the ribbon's length direction. The digital data for $Si_2B_{16}$, $Si_3B_{15}$ and $Si_4B_{14}$ alloy ribbons are also listed in Table 7.

TABLE 7

| | $Si_2B_{16}$ Alloy | | $Si_3B_{15}$ Alloy | | $Si_4B_{14}$ Alloy | |
|---|---|---|---|---|---|---|
| Induction $B_m$ (T) | Core Loss (W/kg) | Exciting Power (VA/kg) | Core Loss (W/kg) | Exciting Power (VA/kg) | Core Loss (W/kg) | Exciting Power (VA/kg) |
| 1.0 | 0.125 | 0.150 | 0.138 | 0.161 | 0.136 | 0.161 |
| 1.1 | 0.151 | 0.188 | 0.165 | 0.198 | 0.163 | 0.197 |
| 1.2 | 0.181 | 0.237 | 0.196 | 0.245 | 0.192 | 0.241 |

TABLE 7-continued

| Induction $B_m$ (T) | $Si_2B_{16}$ Alloy Core Loss (W/kg) | $Si_2B_{16}$ Alloy Exciting Power (VA/kg) | $Si_3B_{15}$ Alloy Core Loss (W/kg) | $Si_3B_{15}$ Alloy Exciting Power (VA/kg) | $Si_4B_{14}$ Alloy Core Loss (W/kg) | $Si_4B_{14}$ Alloy Exciting Power (VA/kg) |
|---|---|---|---|---|---|---|
| 1.3 | 0.216 | 0.314 | 0.229 | 0.308 | 0.225 | 0.299 |
| 1.35 | 0.235 | 0.375 | 0.246 | 0.350 | 0.242 | 0.349 |
| 1.4 | 0.255 | 0.474 | 0.265 | 0.407 | 0.261 | 0.388 |
| 1.45 | 0.278 | 0.649 | 0.284 | 0.494 | 0.281 | 0.466 |
| 1.5 | 0.305 | 1.02 | 0.306 | 0.640 | 0.302 | 0.608 |
| 1.55 | 0.330 | 1.69 | 0.332 | 0.952 | 0.329 | 0.964 |
| 1.6 | 0.378 | 4.28 | 0.370 | 1.87 | 0.367 | 2.15 |

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A ferromagnetic amorphous alloy ribbon comprising:

an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities;

the ribbon having been cast from a molten state of the alloy, with a molten alloy surface tension of greater than or equal to 1.1 N/m, the ribbon having a ribbon length, a ribbon thickness, a ribbon width, and a ribbon surface facing a casting atmosphere side, the ribbon having ribbon surface defects on the ribbon surface facing the casting atmosphere side, the ribbon surface defects being measured in terms of a defect length, a defect depth, and defect occurrence frequency, the defect length along a direction of the ribbon's length being between 5 mm and 200 mm, the defect depth being less than 0.4 33 t μm and the defect occurrence frequency being greater than zero and less than 0.05 ×w times per 1.5 m of ribbon length, where t is the ribbon thickness and w is the ribbon width in mm, and the ribbon having a saturation magnetic induction exceeding 1.60 T and exhibiting a magnetic core loss of less than 0.14 W/kg when measured at 60 Hz and at a 1.3 T induction level in an annealed straight strip form, and a core magnetic loss of less than 0.3 W/kg and an exciting power of less than 0.4 VA/kg when measured at 60 Hz and at a 1.3 T induction level in an annealed wound transformer core form.

2. The ferromagnetic amorphous alloy ribbon of claim 1, wherein the Si content b and the B content c are related to the Fe content a and the C content d according to relations of b≥166.5×(100−d)/100−2a and c≤a−66.5 ×(100−d)/100.

3. The ferromagnetic amorphous alloy ribbon of claim 1, further comprising a content of Cu being between 0.005 wt. % and 0.20 wt. %.

4. The ferromagnetic amorphous alloy ribbon of claim 1, further comprising a content of Mn being between 0.05 wt. % and 0.30 wt. %, and a content of Cr being between 0.01 wt. % and 0.2 wt. %.

5. The ferromagnetic amorphous alloy ribbon of claim 1, wherein up to 20 at. % of Fe is optionally replaced by Co, and up to 10 at. % Fe is optionally replaced by Ni.

6. The ferromagnetic amorphous alloy ribbon of claim 1, wherein the ribbon has been cast from a molten state of the alloy at temperatures between 1,250° C. and 1,400° C.

7. The ferromagnetic amorphous alloy ribbon of claim 1, wherein the ribbon has been cast in an environmental atmosphere containing less than 5 vol. % oxygen gas at the molten alloy-ribbon interface.

8. The ferromagnetic amorphous alloy ribbon of claim 1, wherein the ribbon comprises a portion 100 mm in width and 1.5 m in length, the portion having a defect occurrence count of less than 5.

9. A wound transformer core, comprising:

a ferromagnetic amorphous alloy ribbon, the ribbon being annealed in magnetic fields applied along the direction of the ribbon's length, and the core exhibiting magnetic core loss of less than 0.3 W/kg and exciting power of less than 0.4 VA/kg when measured at 60 Hz and 1.3 T induction, the ribbon being cast and configured to control a defect in the ribbon from an alloy having a chemical composition represented by $Fe_aSi_bB_cC_d$ where 81≤a<82.5 at. %, 2.5<b<4.5 at. %, 12≤c≤16 at. %, 0.01≤d≤1 at. % with a+b+c+d=100 and satisfying the relations of b≥166.5×(100−d)/100−2a and c≤a−66.5×(100−d)/100, the ribbon haying been cast from a molten state of the alloy, with a molten alloy surface tension of greater than or equal to 1.1 N/m, the alloy having a trace element selected from at least one of Cu, Mn, and Cr, the Cu content is at 0.005-0.20 wt. %, the Mn content is at 0.05-0.30 wt. % and the Cr content is at 0.01-0.2 wt. %, the alloy having less than 20 at. % Fe optionally replaced by Co, and less than 10 at. % Fe optionally replaced by Ni, the ribbon haying ribbon surface defects on the ribbon surface facing the casting atmosphere side, the ribbon surface defects being measured in terms of a defect length, a defect depth, and defect occurrence frequency, and the ribbon having surface defects that are controlled during formation on a surface of the ribbon, the defect length along a direction of the ribbon's length being between 5 mm and 200 mm, the defect depth being less than 0.4 ×t μm, the defect occurrence frequency being greater than zero and less than 0.05 ×w times per 1.5 m of ribbon length, where t is the ribbon thickness and w is the ribbon width in mm, by controlling a molten metal surface tension during a casting of the ribbon from a molten state of the alloy.

10. The wound transformer core of claim 9, where the ribbon has been annealed in magnetic fields applied along the direction of the ribbon's length, and the core exhibiting magnetic core loss of less than 0.25 W/kg and exciting power of less than 0.35 VA/kg when measured at 60 Hz and 1.3 induction.

11. The wound transformer core of claim 10, wherein the ribbon has been annealed in a temperature range between 300° C. and 335° C.

12. The wound transformer core of claim 10, being operated up to an induction level of 1.5 T at room temperature.

13. The wound transformer core of claim 9, having a toroidal shape or semi-toroidal shape.

14. The wound transformer core of claim 9, having step-lap joints.

15. The wound transformer core of claim 9, having overlap joints.

16. A method of fabricating a ferromagnetic amorphous alloy ribbon, the method comprising:

selecting an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities;

casting the ribbon from a molten state of the alloy in an environmental atmosphere containing less than 5 vol. % oxygen gas at the molten alloy-ribbon interface, the casting performed with a molten alloy surface tension greater than or equal to 1.1 N/m; and obtaining the ribbon having a ribbon length, a ribbon thickness, and a ribbon width, wherein the ribbon has ribbon surface defects that are controlled during formation by controlling a surface tension of the alloy in a molten state during the casting and are measured in terms of a defect length, a defect depth, and defect occurrence frequency, wherein the defect length along a direction of the ribbon's length is between 5 mm and 200 mm, the defect depth is less than 0.4 ×t μm and the defect occurrence frequency is greater than zero and less than 0.05 ×w times per 1.5 m of ribbon length, where t is the ribbon thickness and w is the ribbon width in mm, and wherein the ribbon has a saturation magnetic induction exceeding 1.60 T and exhibiting a magnetic core loss of less than 0.14 W/kg when measured at 60 Hz and at a 1.3 T induction level in an annealed straight strip form, and a core magnetic loss of less than 0.3 W/kg and an exciting power of less than 0.4 VA/kg when measured at 60 Hz and at a 1.3 T induction level in an annealed wound transformer core form.

17. The method of claim 16, wherein the Si content b and the B content c are related to the Fe content a and the C content d according to relations of b ≥166.5×(100−d)/100−2a and c≤a−66.5 ×(100−d)/100.

18. The method of claim 16, wherein the alloy further comprises a content of Cu being between 0.005 wt. % and 0.20 wt. %.

19. The method of claim 16, wherein the alloy further comprises a content of Mn being at 0.05-0.30 wt. % and a content of Cr being at 0.01-0.2 wt. %.

20. The method of claim 16, wherein up to 20 at. % of Fe is optionally replaced by Co, and up to 10 at. % Fe is optionally replaced by Ni.

21. The method of claim 16, wherein the ribbon is cast from a molten state of the alloy at temperatures between 1,250° C. and 1,400° C.

22. The method of claim 16, wherein the ribbon obtained comprises a portion 100 mm in width and 1.5 m in length, the portion having a defect occurrence count of less than 5.

* * * * *

UNITED STATES PATENT AND TRADEMARK OFFICE

CERTIFICATE OF CORRECTION

PATENT NO. : 8,968,489 B2
APPLICATION NO. : 12/923076
DATED : March 3, 2015
INVENTOR(S) : Daichi Azuma et al.

It is certified that error appears in the above-identified patent and that said Letters Patent is hereby corrected as shown below:

Title Page, item (57), in the Abstract
Line 5, delete "alloy," and insert -- alloy --, therefor.
Line 6, delete "a-surface" and insert -- a surface --, therefor.
Line 6, delete "N/mi,." and insert -- N/m. --, therefor.

In the Claims
Column 11, Line 42, in Claim 1, delete "0.4 33 t μm" and insert -- 0.4×t μm --, therefor.
Column 12, Line 35, in Claim 9, delete "haying" and insert -- having --, therefor.

Signed and Sealed this
Seventh Day of July, 2015

Michelle K. Lee

Michelle K. Lee
*Director of the United States Patent and Trademark Office*